US005614877A

United States Patent [19]

Raghavan et al.

[11] Patent Number: 5,614,877

[45] Date of Patent: Mar. 25, 1997

[54] BICONICAL MULTIMODE RESONATOR

[75] Inventors: Krishnan Raghavan, Torrance; Rolf Kich, Redondo Beach; Paul J. Tatomir, Laguna Niguel, all of Calif.

[73] Assignee: Hughes Aircraft Co., Los Angeles, Calif.

[21] Appl. No.: 405,423

[22] Filed: Mar. 15, 1995

Related U.S. Application Data

[63] Continuation of Ser. No. 163,023, Dec. 6, 1993, abandoned.

[51] Int. Cl.[6] ..... H01P 7/06

[52] U.S. Cl. ..... 333/227; 333/230

[58] Field of Search ..... 533/208–212, 533/227–230

[56] References Cited

U.S. PATENT DOCUMENTS

| | | | |
|---|---|---|---|
| 3,110,000 | 11/1963 | Churchill | 333/208 |
| 3,697,898 | 10/1972 | Blachier et al. | 333/209 X |
| 5,012,211 | 4/1991 | Young et al. | 333/209 X |
| 5,179,363 | 1/1993 | Schwartz et al. | 333/230 X |

FOREIGN PATENT DOCUMENTS

| | | | |
|---|---|---|---|
| 5142332 | 6/1993 | Japan . | |
| 1821848 | 6/1993 | Russian Federation | 333/208 |
| 1483520 | 5/1989 | U.S.S.R. . | |
| 1800522 | 3/1993 | U.S.S.R. . | |

OTHER PUBLICATIONS

H. L. Thal Jr., "Cylindrical TE011/TM111 Mode Control by Cavity Shaping", IEEE Transactions On Microwave Theory and Techniques, vol. 27, No. 12, Dec. 1979, New York, pp. 982–986.

W. C. Tang et al., "A True Elliptic–Function Filter Using Triple–Mode Degenerate Cavities", IEEE Transactons On Microwave Theory And Techniques, vol. 32, No. 11, Nov. 1984, New York, pp. 1449–1454.

Volgelman, "High–power Microwave Rejection Filters Using Higher–Order Modes", IRE Trans. on a Microwave Theory & Techniques, Oct., 1959, pp. 461–465.

*Primary Examiner*—Benny Lee

*Attorney, Agent, or Firm*—Elizabeth E. Leitereg; Terje Gudmestad; Wanda K. Denson-Low

[57] ABSTRACT

A bandpass microwave filter (32) is constructed by use of a right cylindrical cavity resonator (10) wherein end regions (22, 24) of the resonator are tapered. The tapering is accomplished by replacing end portions of a right cylindrical sidewall with frusto-conic sections (22, 24) of side wall. Each frusto-conic section joins a central cylindrical section (26) of the sidewall with a planar end wall (14, 16). Each of the end walls is provided with a coupling slot (28, 30) having dimensions substantially smaller than a half wavelength of the center resonant frequency of the resonator so as to be a nonresonant slot. The slots in the end walls may be coupled to rectangular waveguides (34, 36) which form input and output ports by which electromagnetic signals are applied to and extracted from the resonator.

11 Claims, 1 Drawing Sheet

BICONICAL MULTIMODE RESONATOR

This is a continuation application Ser. No. 08/163,023, filed Dec. 6, 1993, now abandoned.

BACKGROUND OF THE INVENTION

This invention relates to microwave filters and, more particularly, to a filter constructed as a cylindrical cavity with conically tapered end portions to provide a resulting resonator which is a cascade of two conical sections joined by a cylindrical section. The resulting filter provides increased bandwidth and reduced spurious response.

Microwave filters are employed widely in electromagnetic communication systems. For example, in satellite communication systems, the filters are used to define up-link and down-link communication channels. High Q microwave filters in the 3.7–4.2 GHz frequency range are currently constructed using $TE_{111}$ cylindrical mode resonators. For certain applications, it is desirable to extend the passband down to 3.4 GHz.

A problem arises in that the presently available cylindrical resonator operating in the $TE_{111}$ mode does not function adequately well over the entire band of 3.4–4.2 GHz band due to the presence of extraneous TM modes which resonate within the band. This results in a degradation of filter performance. As a result of this limitation, previous C-band work in the 3.4–4.2 GHz frequency range could be accomplished with a $TE_{111}$ resonator only by dividing up the band into two sub-bands which might then be diplexed together, thereby to avoid the TM mode interference. However, such utilization of the resonator is not available in a communication situation requiring continuous use of the entire frequency band. Use of the entire frequency band requires that the resonator be free of a spurious mode over the entire band.

SUMMARY OF THE INVENTION

The aforementioned problem is overcome and other advantages are provided by a microwave filter employing a cavity resonator comprising three portions, namely, a central portion having the shape of a right circular cylinder and two end portions which are tapered to meet end walls of the cavity. Each of the end walls of the cavity has a smaller cross section than the cross section of the central portion of the cavity. In a preferred embodiment of the invention, each of the end portions is provided with a tapered surface generated by rotation of a straight line about a central axis of the cavity resonator, the line being inclined slightly relative to the axis, to provide the tapered surface with the configuration of the frustom of a right circular cone. However, if desired other forms of taper can be employed such a tapered surface produced by rotation of an elliptical arc about the central axis. This configuration of resonator inhibits the generation of spurious modes of resonance of electromagnetic waves so as to accomplish an object of the invention which is to increase the passband of a microwave filter employing the resonator.

The resonator of the invention is advantageous in offering an added degree of freedom in design of the resonator. Thus, the length and diameter can be adjusted to control and actually use a TM mode as a third cavity resonance. In such case, the result is a triple mode resonator with superior Q and an even wider bandwidth which is free of spurious modes. The physical dimensions of the resonator can be scaled to provide operation in various frequency bands, such as L-band, C-band and X-band, by way of example.

The invention operates by shifting the resonant frequency of one electromagnetic mode of vibration relative to another electromagnetic mode of vibration. The primary mode employed for communication of electromagnetic signals between input and output ports of the resonator is the $TE_{111}$ mode, the frequency of which is dependent on the diameter of the central cylindrical section, the bevel angle of an end conical portion, and the overall length of the resonator along a central axis thereof. The frequency of the $TE_{111}$ mode falls between the frequencies of the spurious $TM_{010}$ mode and the spurious $TM_{011}$ mode, the frequency of the $TE_{111}$ mode being greater than the frequency of the spurious $TM_{010}$ mode. The decrease in the diameter of the end regions of the resonator cavity affects differently the frequencies of the various modes so as to increase the spectral spacing of the modes. Thus the frequency of the $TE_{111}$ mode is raised relative to the frequency of the spurious $TM_{010}$ mode, and the frequency of the spurious $TM_{011}$ mode is raised still further relative to the $TE_{111}$ mode. The invention takes advantage of this differential amount of frequency offset of the various modes to shift the spurious modes away from the frequency of the fundamental $TE_{111}$ mode to enlarge the passband of the resonator.

BRIEF DESCRIPTION OF THE DRAWING

The aforementioned aspects and other features of the invention are explained in the following description, taken in connection with the accompanying drawings wherein.

DETAILED DESCRIPTION

Figure 1:
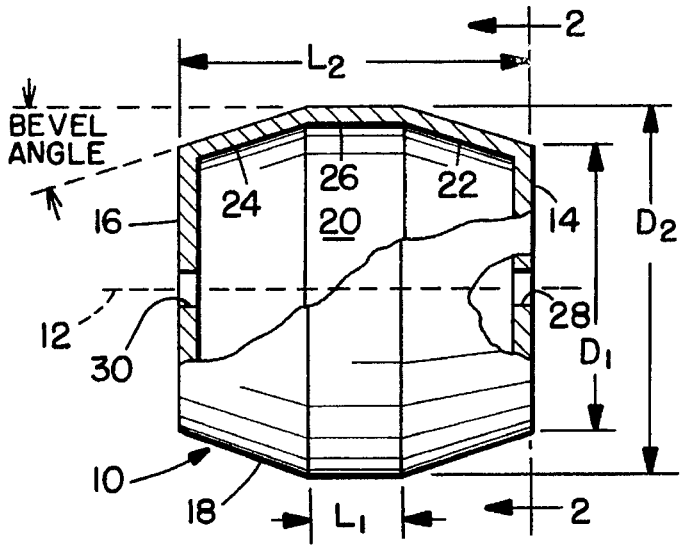
FIG. 1 is a side view, partially cut away and sectioned, of a resonator cavity employed in constructing the filter of the invention.
Figure 2:
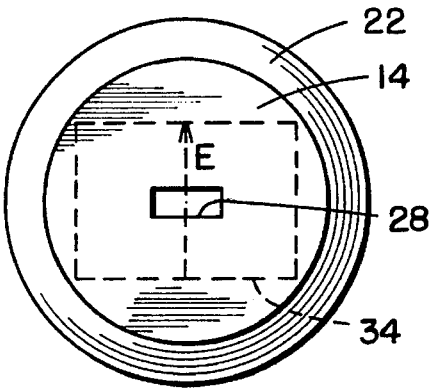
FIG. 2 is an end view of the resonator cavity taken along the line 2—2 of FIG. 1, FIG. 2 showing also the location of a rectangular waveguide, indicated in phantom view, coupled by a slot to the resonator cavity.
Figure 3:
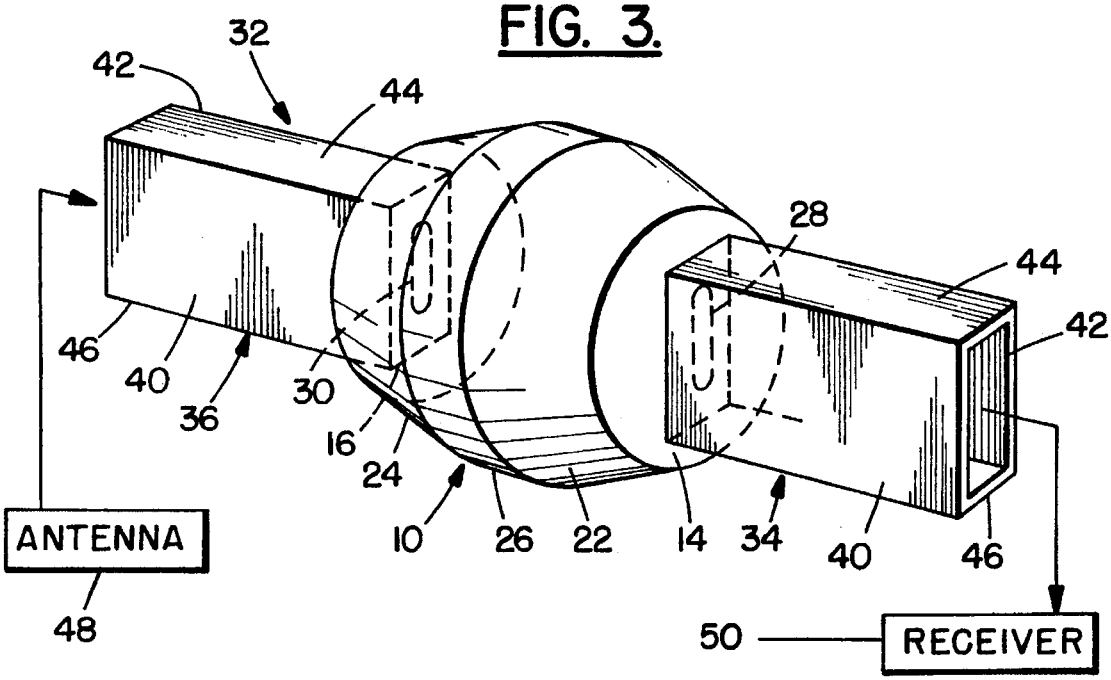
FIG. 3 is a stylized view, partially diagrammatic, of the filter of the invention connected between a satellite antenna and a satellite receiver.

With reference to FIGS. 1, 2 and 3, a cavity resonator 10 is constructed of electrically conductive material such as silver-plated aluminum or invar, and has circular symmetry about a central axis 12. The resonator 10 comprises opposed planar end walls 14 and 16 which are joined by a sidewall 18 to define an enclosed region 20 of the resonator 10. The end walls 14 and 16 are perpendicular to the axis 12. The sidewall 18 comprises two frustoconical sections 22 and 24 which connect respectively with the peripheral edges of the end walls 14 and 16, and which are joined by a right-cylindrical central section 26. Coupling of electromagnetic power into and out of the resonator 10 is accomplished by means of slots 28 and 30 disposed along the axis 12 respectively in the end wall 14 and the end wall 16. The dimensions of the slots 28 and 30 are substantially less than that of one-half wavelength of the electromagnetic radiation at the center frequency of the resonator 10 so as to function as nonresonant slots, a typical slot length being in the range of ⅙ to ⅓ of a guide wavelength. Thereby, the dimensions of the slots have no more than a negligible effect upon the frequency characteristics of the resonator 10. As shown in FIG. 1. the axial length of the center section 26 is represented by L1, the overall length of the resonator 10 is represented by L2, the diameter of the end wall 14 is represented by D1, and the diameter of the center section 26 is represented by D2. In a preferred embodiment of the invention, the diameter of the end wall 16 is equal to the diameter of the end wall 14. However, in the general case of construction of the resonator 10, the diameters of the end walls 14 and 16 may differ. The frusto-conical sections 22 and 24 may be described in terms of a bevel angle, as indicated in FIG. 1.

Construction of a filter 32, as shown in FIG. 3, is accomplished by providing two rectangular waveguides 34 and 36 connecting, respectively, with the end walls 14 and 16 of the resonator 10 to serve as input and output ports of the resonator 10. An end of the waveguide 34 butts against the end wall 14 which serves also as an end wall of the waveguide 34. The slot 28 of the end wall 14 provides for coupling of the electromagnetic power between the waveguide 34 and the resonator 10. In similar fashion, an end of the waveguide 36 butts against the end wall 16 which serves also as an end wall of the waveguide 34, and the slot 30 of the end wall 16 provides for coupling of the electromagnetic power between the waveguide 36 and the resonator 10.

By way of example, as shown in FIGS. 2 and 3, each of the waveguides 34 and 36 is provided with a rectangular configuration having opposed broad walls 40 and 42 joined by sidewalls 44 and 46, wherein the broad wall has a width quadruple the width of a sidewall, so-called half height waveguide. Each of the slots 28 and 30 of the waveguides 34 and 36, respectively, is elongated in a direction transverse to the longitudinal axis of the waveguide and parallel to the broad wall 40. The slot length is greater than its width in accordance with the usual design of slots so as to avoid coupling of higher modes of radiation, while avoiding an overly narrow width so as to be able to couple a high power without arcing of the electric field across the slot. In the preferred embodiment of the invention, each of the slots 28 and 30 has a length of approximately one inch, and a width of 0.2 inch. Preferably, the slots 28 and 30 are parallel and are identical in size and configuration. The electric field in each of the waveguides 34 and 36 is oriented in a direction perpendicular to the long dimension of the respective one of the slots 38 and 28. By way of example, in the use of the filter 32 for a satellite, a communications antenna 48 of the satellite may be coupled via the filter 32 to a receiver 50 of the satellite, the connection being established by coupling the antenna 48 to the waveguide 36, and by coupling the receiver 50 to the waveguide 34.

By way of further example in the construction of the filter 32, a passband in the frequency range of 3.4 to 4.2 GHz is attained by constructing the resonator 10 with the following dimensions, namely, the length L1 and L2 have values of 0.35 inch and 1.950 inch, respectively, and the diameters D1 and D2 have values of 2.52 inch and 3.0 inch, respectively. This provides a filter center frequency of 3.91 GHz at the $TE_{111}$ mode, a resonance frequency of 4.70 GHz for the $TM_{011}$ mode, and a resonance frequency of 3.24 GHz for the $TM_{010}$ mode. The axial length of the cavity, L2, is equal to one-half the guide wavelength of the $TE_{111}$ mode at its resonant frequency. The diameter D2 of the center section 26 is equal to approximately 0.9 free-space wavelengths of the $TE_{111}$ mode at its resonant frequency. In the construction of the waveguides 34 and 36, each of the broad walls 40 and 42 has a width of 2.29 inches, and each of the sidewalls 44 and 46 has a width of 0,573 inch.

In the operation of the resonator 10, the magnetic fields of cylindrical $TM_{011}$ modes have maximum amplitude at the ends of the cavity. A constriction, by reduction of the diameter of an end wall 14, 16 from that of the center section 26, as shown in FIG. 1, causes an increase in the natural resonant frequency of the $TM_{011}$ mode. Since the cross sectional area in each of the conical regions is less than in the cylindrical section, the effective cutoff frequency is increased. Therefore, an increase in the frequency of the $TM_{011}$ mode resonance occurs for cavities of a given length. The frequency of the $TE_{111}$ mode to be used in the resonator 10 is effected by the beveling of the conic end portions of the cavity to a lesser degree than the frequency of the $TM_{011}$ mode because a much smaller percentage of the magnetic field energy of the $TE_{111}$ mode is located in the end regions of the resonator 10. The cavity resonator 10 is operational in a triple mode fashion using the $TM_{010}$ mode and two orthogonal $TE_{111}$ modes, the modes being degenerate by a physical adjustment of the resonator 10 which is accomplished during manufacture of the resonator 10 by establishment of the bevel angle (shown in FIG. 1).

Therefore, the resonant frequency of the $TE_{111}$ mode increases less than that of the $TM_{011}$ mode. However, with respect to the $TM_{010}$ mode, the electromagnetic field is constant along the length of the resonator 10. Effects upon the frequency of the $TM_{010}$ mode by the constrictions of the diameters of the end regions of cavity and the enlarged central diameter of the center section are approximately canceled resulting in a very small overall change in the $TM_{010}$ mode resonant frequency. As a result, the net increase in frequency of each of the foregoing modes brought on by reduction of the diameters of end walls 14 and 16 results in a selective shifting of the frequencies of the respective modes such that the resonant frequency of the $TM_{010}$ mode is shifted only a negligible amount, there is a significant increase in the resonant frequency of the $TE_{111}$ mode, and a still larger shift in the resonant frequency of the $TM_{011}$ mode. Thus, the spurious TM modes are moved away from each other in terms of their spectral spacing so as to enlarge the usable frequency band between the resonant frequencies of these spurious modes. Fine adjustment of the value of the $TE_{111}$ mode frequency can be attained by slight adjustment of the central section diameter D2, the bevel angle, and the overall length L2. As a result, the spurious $TM_{010}$ and $TM_{011}$ mode resonances are placed respectively below and above the frequency band of interest. In terms of the mathematical description of the operation of the resonator 10, the resonator is two fold degenerate in the $TE_{111}$ mode as is the case for a normal cylindrical resonator without the beveling of its end regions.

By way of further example In the construction of the resonator 10, spurious resonant frequencies of 3.18 GHz and 4.23 GHz are obtained with a central frequency of 3.42 GHz by constructing the resonator with the following dimensions, namely, L1=0.85 inch, L2=2.450 inch, D1=2.520 inch, and D2=3.0 inch. As a further example in the construction of the resonator 10, spurious resonant frequencies of 3.26 GHz and 4.99 GHz are contained with a central frequency of 4.24 GHz by constructing the resonator with the following dimensions, namely, L1=0.175 inch, L2=1.725, D1=2.520 inch, and D2=3.0 inch.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A microwave cavity resonator comprising:

a sidewall having circular symmetry about a central axis of the resonator, and two opposed end walls disposed at opposite ends of the sidewall for enclosing an interior region of the resonator, each of said end walls being disposed transversely of said central axis;

wherein said sidewall has a central region and two opposed end regions joined by said central region, and said central region of the sidewall is a section of a cylinder having a predetermined cross section larger than a respective cross section associated with each of said end walls;

said respective end regions of said sidewall are tapered to meet corresponding ones of said end walls; and an axial length of the central region of the sidewall, as measured along the central axis, is less than a respective axial length of either of said two opposed end regions of said sidewall, as measured along the central axis.

2. A resonator according to claim 1 wherein said central region of said sidewall has the form of a right circular cylinder.

3. A resonator according to claim 1 wherein each of said end regions of said sidewall has a respective frusto-conical shape.

4. A resonator according to claim 1 wherein said central region of said sidewall has the form of a right circular cylinder and each of said end regions of said sidewall has the form of a respective frustum of a right circular cone.

5. A resonator according to claim 4 further comprising a respective coupling slot disposed in each of said end walls.

6. A resonator according to claim 5 wherein the respective coupling slot in each of said end walls is nonresonant at an operating frequency band of said resonator.

7. A resonator according to claim 6 operative to provide electromagnetic radiation in a $TM_{010}$ mode, a $TE_{111}$ mode and a $TM_{011}$ mode wherein a tapering of said respective end regions of said sidewall further offsets the resonant frequency of the $TM_{011}$ mode from the resonant frequency of the $TM_{010}$ mode, the resonant frequency of the $TE_{111}$ mode lying between the resonant frequency of the $TM0_{010}$ mode and the resonant frequency of the $TM_{011}$ mode for an enlarged pass band of said resonator.

8. A resonator according to claim 7 wherein said sidewall and each of said respective end walls comprise electrically conductive material.

9. A resonator according to claim 6 wherein the resonator is operational in a triple mode fashion using the $TM_{010}$ mode and two orthogonal $TE_{111}$ modes, the modes being degenerate by physical adjustment of the resonator.

10. A resonator according to claim 4 operative to provide electromagnetic radiation in a $TM_{010}$ mode, a $TE_{111}$ mode and a $TM_{011}$ mode wherein a tapering of said respective end regions of said sidewall offset the resonant frequency of the $TM_{011}$ mode from the resonant frequency of the $TM_{010}$ mode, the resonant frequency of the $TE_{111}$ mode lying between the resonant frequency of the $TM_{010}$ mode and the resonant frequency of the $TM_{011}$ mode for an enlarged pass band of said resonator.

11. A resonator according to claim 1 wherein each of said end regions has a first cross section at an interface with said central region and a second cross section at an interface with a respective one of said end walls, said first cross section of each of said end regions being larger than said second cross section of each of said end regions, each of said end walls having a respective slot for coupling with a corresponding external waveguide, said smaller cross section of each of said end regions being respectively larger than a respective cross section associated with a corresponding waveguide.

* * * * *